US006269707B1

(12) United States Patent
Koch

(10) Patent No.: US 6,269,707 B1
(45) Date of Patent: Aug. 7, 2001

(54) DRIVE MECHANISM FOR ADJUSTING PARTS IN FURNITURE FOR SITTING AND LYING DOWN

(75) Inventor: Dietmar Koch, Gummersbach (DE)

(73) Assignee: Okin Gesellschaft fur Antriebstechnik mbH & Co. KG, Gummersbach (DE)

( * ) Notice: Subject to any disclaimer, the term of this patent is extended or adjusted under 35 U.S.C. 154(b) by 0 days.

(21) Appl. No.: 09/403,804

(22) PCT Filed: Apr. 9, 1998

(86) PCT No.: PCT/DE98/01040

§ 371 Date: Dec. 17, 1999

§ 102(e) Date: Dec. 17, 1999

(87) PCT Pub. No.: WO98/48667

PCT Pub. Date: Nov. 5, 1998

(30) Foreign Application Priority Data

Apr. 30, 1997 (DE) ..... 197 18 255

(51) Int. Cl.[7] ..... A47C 20/04

(52) U.S. Cl. ..... 74/89.23; 5/616; 297/362.14

(58) Field of Search ..... 74/89.15, 424.8 R, 74/89.23; 5/616, 618; 297/362.14

(56) References Cited

U.S. PATENT DOCUMENTS 3,300,794 * 1/1967 Altorfer ..... 5/616
4,871,246 * 10/1989 Manzoni ..... 74/89.15
5,075,911 * 12/1991 Dewert ..... 5/616

FOREIGN PATENT DOCUMENTS 196 03 539 * 8/1996 (DE) .

* cited by examiner

*Primary Examiner*—David A. Bucci
*Assistant Examiner*—William C Joyce
(74) *Attorney, Agent, or Firm*—Fildes & Outland, P.C.

(57) ABSTRACT

A drive mechanism for adjusting parts in furniture for sitting and lying down includes parts activated via a shaft being provided with a control lever. Adjusting mechanisms which can be driven by an electromotor are provided for driving purposes. The invention provides a drive mechanism which is compact especially with the shafts arranged close to each other. An adjusting mechanism is positioned so that the longitudinal side facing away from the shafts is opposite the longitudinal side of the other adjusting mechanism facing the shafts.

10 Claims, 2 Drawing Sheets

DRIVE MECHANISM FOR ADJUSTING PARTS IN FURNITURE FOR SITTING AND LYING DOWN

CROSS REFERENCE TO RELATED APPLICATION

This application is a 371 of PCT/DE98/01040 filed Apr. 9, 1988.

FIELD OF THE INVENTION

The invention relates to a drive mechanism for adjusting parts in furniture for sitting and lying down, especially for adjustable armchairs, with a housing for accommodating two adjusting mechanisms driven by electromotors, the purpose of each of these being to turn a shaft equipped with a control lever, where the adjusting mechanisms each have an adjusting spindle which engages a gear unit at one head end, and an adjusting element which is bolted to the adjusting spindle, can be moved in the longitudinal direction and has a contact surface resting against the control lever, and are positioned in opposite directions, and where the adjusting mechanisms have a longitudinal side facing the shafts and a longitudinal side facing away from the shafts. In order to be in contact with the contact surface during the horizontal and vertical stroke motion of the adjusting element, the control lever can be positioned in a pocket-like recess in the contact surface. The control lever can also rest against the contact surface of the adjusting element under tension applied by an elastic element.

BACKGROUND OF THE INVENTION

A drive mechanism of this kind is known from DE 88 00 360 U, for example. This is a drive mechanism for slatted bed bases, in which shafts equipped with control levers are operated by two adjusting mechanisms driven by an electromotor. Parts of furniture for sitting or lying down are adjusted via brackets connected in articulated fashion to the shafts which can be turned in this way. Each of the adjusting mechanisms is driven by an electromotor, which drives an adjusting spindle via a gear unit. Turning the adjusting spindle moves the adjusting element and, by applying the adjusting element to the control lever, causes the shaft to turn. The adjusting mechanisms are mounted between the two shafts for this purpose. Furthermore, the adjusting mechanisms are mounted parallel to one another such that the head ends with the respective gear units for driving the adjusting spindles are adjacent to one another.

One disadvantage of these known configurations is that the shafts to be adjusted must be a certain minimum distance apart which approximately corresponds to the length of two adjusting mechanisms. In a configuration of a drive mechanism known from DE 88 00 360 U, the adjusting mechanisms are mounted next to one another between the shafts. A force transmitted from the adjusting mechanisms to the control levers of the shaft generates a reactive force acting on the drive mechanism. One disadvantage of such a configuration of the adjusting mechanisms is that the reactive forces are offset relative to one another and act on the shaft in different planes, thus generating a resulting torque on the drive mechanism.

SUMMARY OF THE INVENTION

The object of the present invention is to avoid the disadvantages described above and provide a drive mechanism which is particularly compact and suitable for use with closely spaced shafts, which are advantageous in armchairs, for example.

According to the invention, the object is solved in that the longitudinal side of the one adjusting mechanism facing away from the shafts is positioned opposite the longitudinal side of the other adjusting mechanism facing the shaft. In this context, both adjusting mechanisms lie in a common plane perpendicular to the rotational axes of the shafts. In this way, the control levers, via which the respective shafts can be turned, also lie in a common plane. Arranging the control levers in a common plane avoids the occurrence of a resulting torque on the drive mechanism.

Due to the fact that the longitudinal sides of the two adjusting mechanisms are positioned opposite one another, the minimum distance required between the shafts is reduced to approximately the minimum length of a single adjusting mechanism. Consequently, the drive mechanism is much more compact and suitable for use with closely spaced shafts.

In an advantageous configuration of the invention, the adjusting mechanisms are essentially positioned opposite one another without offset when the adjusting elements are in the position of the shortest vertical stroke. In the position of the shortest vertical stroke, the adjusting element is essentially screwed all the way up on the threaded spindle, and the entire adjusting mechanism is at its minimum length. This arrangement of the adjusting mechanisms allows a particularly small distance between the shafts.

The adjusting mechanisms are preferably arranged essentially parallel to one another in the housing. This makes a compact housing possible. The depth of the housing runs in the direction perpendicular to the connecting plane of the two rotational axes. The parallel arrangement of the adjusting mechanisms keeps the depth of the housing, in particular, to a minimum. In order to divert the reactive forces generated in the housing by the movement of the shafts, a web can provided between the two adjusting mechanisms which protects the housing against twisting forces and absorbs the reactive forces of both adjusting mechanisms.

The longitudinal direction of the adjusting mechanisms is preferably at an angle to the connecting plane of the shaft axes. The angled arrangement of the adjusting mechanisms can partially compensate for the varying distance of the adjusting mechanisms to the shaft, so that identical control levers can be used to operate the shafts. The use of identical control levers is particularly advantageous in that the lever arms, and thus also the forces exerted on the shaft by the adjusting elements, are essentially of equal size. The use of identical control levers also simplifies manufacturing, stocking and assembly of the drive mechanism. The varying distance of the adjusting elements to the shafts can be compensated for in particularly favourable fashion in that the head end of the adjusting element adjacent to the connecting plane is positioned closer to the connecting plane than its contact surface.

The housing advantageously consists of two integrally moulded half-shells with mounting elements for the gear units. The forces acting on the adjusting element via the control lever are transmitted via the threaded spindle to the gear unit and its mounting element. The mounting elements, which are integrally moulded in the half-shells of the housing, transmit the reactive forces to the housing. With a correspondingly sturdy connection of the housing areas in which the mounting elements are moulded, the reactive forces can be set against the tension forces in the housing. Another advantage of integrally moulded half-shells is that, during assembly of the drive, the adjusting mechanisms need only be inserted into one half-shell and are fixed in place in the housing by closing the second half-shell.

The adjusting elements are preferably guided in at least one half-shell by ribs arranged in the longitudinal direction. Guiding the adjusting elements in this manner increases their stability and enables precise guidance of the adjusting elements over the entire stroke range of the threaded spindle.

Each of the shafts is preferably mounted in a recess in the housing, where the recess has two side walls facing the shaft and the side wall farthest away from the gear unit of the adjusting element acting on the shaft forms a roughly right or acute angle with the normal direction of the contact surface at the contact point of the control lever. The normal direction of a surface at a point is the direction perpendicular to the surface through the point. Actuating the control lever exerts a force on the control lever at the contact point of the control lever in the normal direction of the contact surface. The force component in the direction of the connecting line from the contact point to the rotational axis of the shaft is transmitted via the control lever to the shaft as a transverse force. The force component perpendicular to the connecting line from the contact point to the rotational axis of the shaft is transmitted to the shaft as a torque.

The transverse force is partially absorbed by the side wall of the recess. Disregarding the deformation and friction forces of the shaft in the recess, it is the component of the transverse force in the normal direction of the side wall that is essentially absorbed. Due to the fact that the direction of the side wall of the recess forms a roughly right or acute angle with the normal direction of the contact surface, some of the transverse force is absorbed by the side wall. In this context, the angles are measured from the direction of the side wall towards the contact surface, where the direction of the 0° angle should point towards the recess. If the side wall which absorbs the force forms an acute angle with the longitudinal direction of the adjusting element, and if the normal direction of the contact surface also forms an acute angle with the longitudinal direction of the adjusting element, the transverse forces acting on the shaft can also be absorbed, if the side wall and the normal direction form a roughly right angle.

In an advantageous configuration, the normal direction of the contact surface points in the longitudinal direction of the respective adjusting spindle and the side wall of the recess farthest away from the gear unit of the adjusting element acting on the shaft forms a roughly right or acute angle with the normal direction of the contact surface. One advantage of this configuration for reducing the transverse force occurring along the connecting line of the contact point of the control lever to the rotational axis of the shaft, is that the contact surface of the adjusting element is perpendicular to the longitudinal direction, and that two identical adjusting elements can thus be arranged in the housing. This also simplifies manufacturing, stocking and the assembly of the adjusting mechanisms in the housing.

In another version of the drive mechanism according to the invention, the side walls of the recess are essentially perpendicular to the connecting plane of the shaft axes and form an acute angle with the normal direction of the contact surface of the adjusting element acting on the shaft. Due to the orientation of the contact surface, the force exerted by the adjusting mechanism on the control lever displays only a weak force component along the connecting line from the contact point of the control lever to the rotational axis of the shaft.

The motors are preferably mounted on one side of the housing perpendicular to the longitudinal direction of the adjusting spindle. The advantage of this kind of arrangement of the motors is that the housing, or the entire drive mechanism, has very narrow dimensions in the direction of the rotational axes of the shafts.

An example of the invention is illustrated in the figures and explained in detail below.

DETAILED DESCRIPTION OF THE INVENTION

Figure 1:
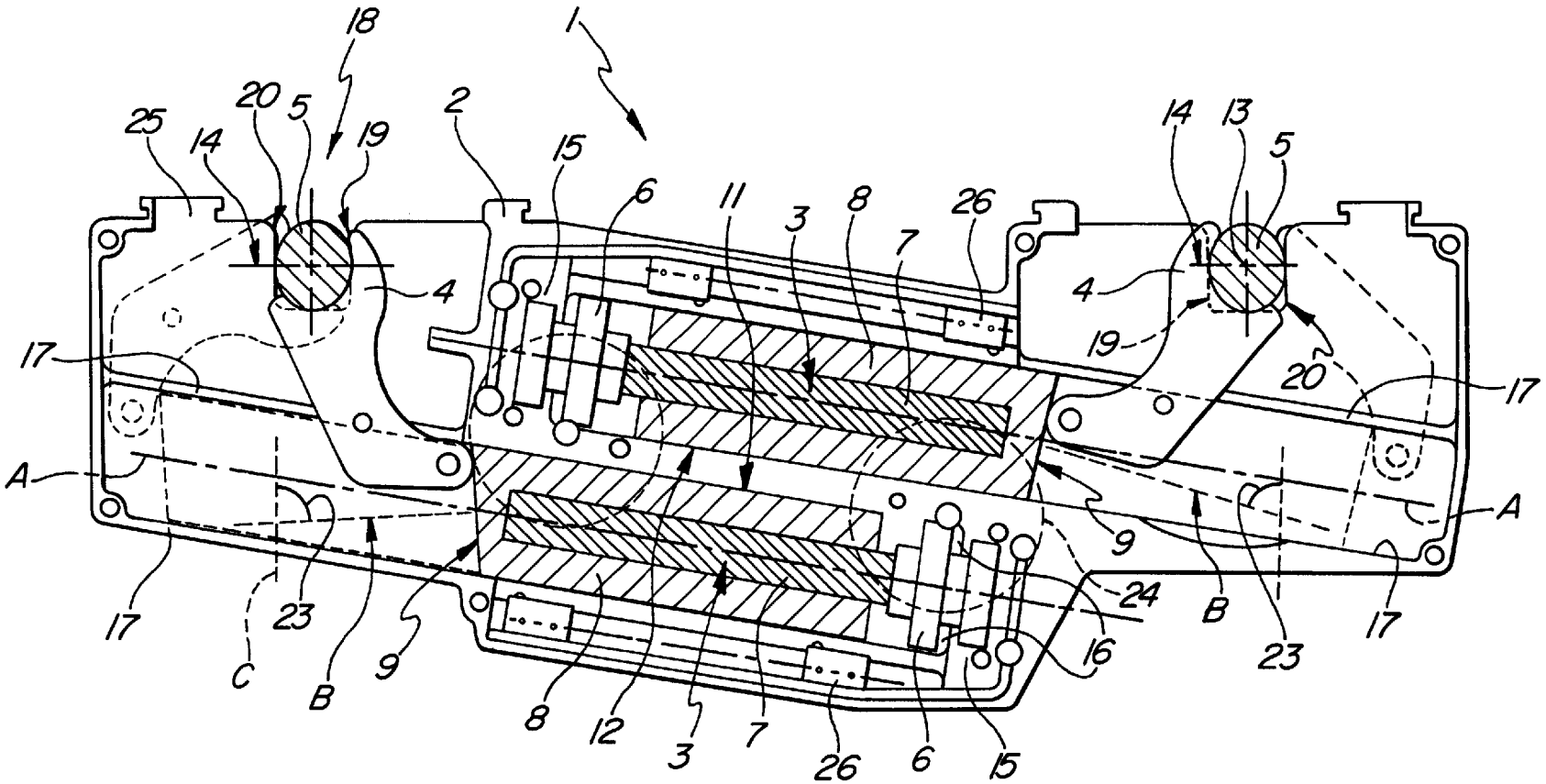
FIG. 1 Top view of a drive mechanism according to the invention.

Drive mechanism 1 shown in FIG. 1 essentially consists of a housing 2 defined by two integrally molded half shells 2*a* and 2*b*, the latter being cut away to show the interior, with two adjusting mechanisms 3. Each adjusting mechanism 3 is positioned in housing 2 in such a way that its contact surface 9 is in contact with control lever 4.

Control lever 4 is connected to shaft 5 in non-rotating fashion. Actuating adjusting mechanism 3 turns shaft 5 such that a bracket or the like attached to it can be actuated in order to move parts of furniture for sitting and lying down.

Adjusting mechanism 3 has a gear unit 6. Gear unit 6 can consist, for example, of a worm gear engaged by a drive pinion of a motor 24. Gear unit 6 turns adjusting spindle 7 of adjusting mechanism 3 and moves adjusting element 8 in longitudinal direction A in the manner of an adjusting nut.

Figure 2:
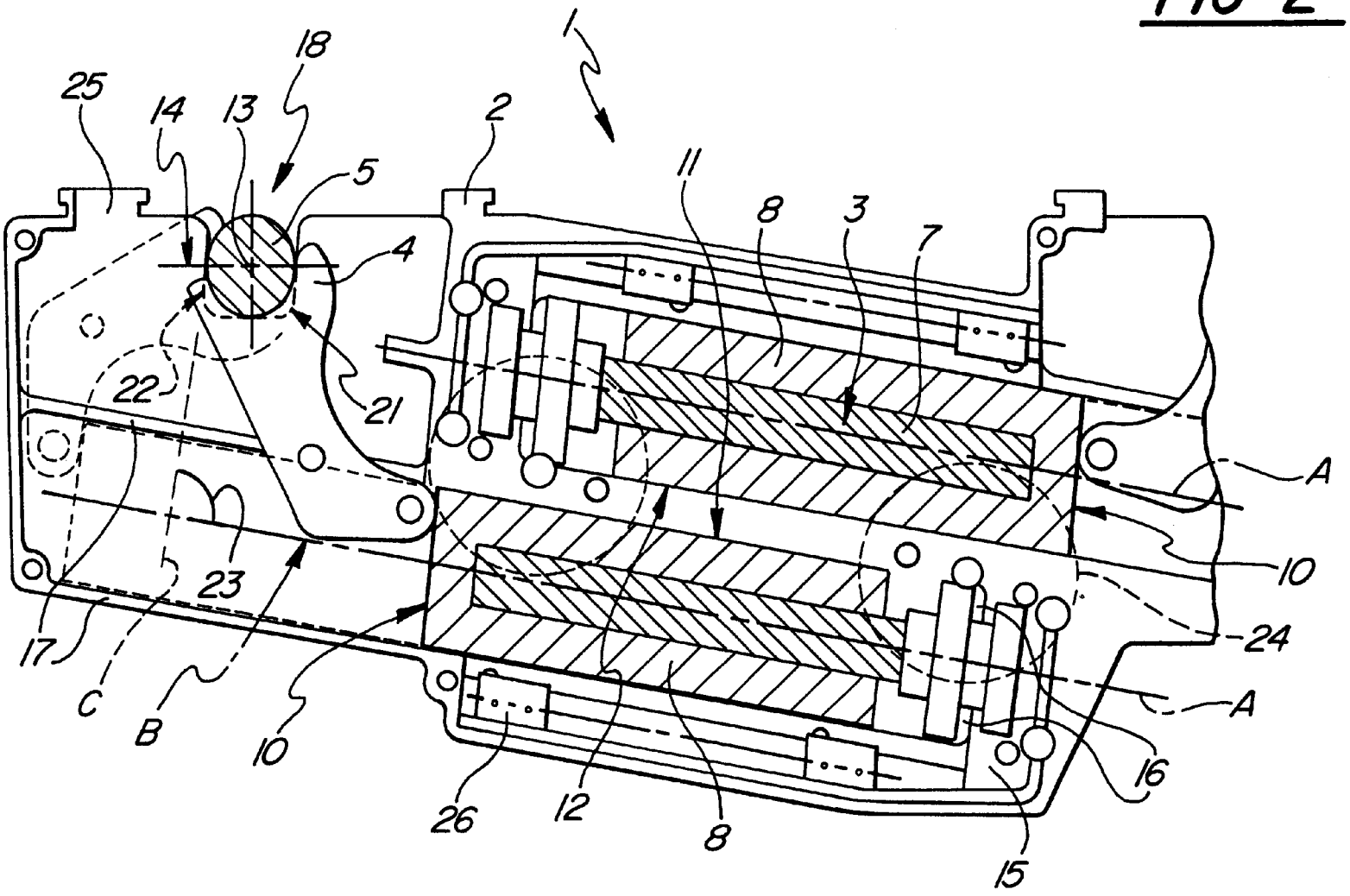
FIG. 2 A section of a second configuration of a drive mechanism according to the invention.

In the practical examples shown in FIGS. 1 and 2, adjusting mechanisms 3 are positioned parallel to one another between shafts 5. In this context, longitudinal side 11 and 12 of adjusting mechanism 3 is taken to mean the plane side surface, regardless of how far adjusting element 8 is screwed onto adjusting spindle 7. Adjusting mechanisms 3 are positioned in housing 2 in such a way that both control levers 4 of the shaft lie in the same plane perpendicular to shaft axes 13. In the practical examples shown, adjusting mechanisms 3 are positioned opposite one another without offset. If there were a greater distance between shafts 5, the two adjusting mechanisms 3 could be arranged in an offset position relative to one another along their longitudinal direction A, so that housing 2 would have a smaller depth.

Longitudinal direction A of the adjusting mechanisms forms an angle other than 0° with connecting plane 14 of shaft axes 13. In this context, the head end with gear unit 6 of adjusting mechanism 3 adjacent to connecting plane 14 is closer to connecting plane 14.

In the practical example shown in FIG. 1, normal direction B of contact surface 9 forms an acute angle with longitudinal direction A. When adjusting element 8 moves, control lever 4 moves along contact surface 9. This causes a torque to be transmitted to shaft 5.

Shaft 5 is mounted in recess 18 of housing 2. Recess 18 has two side walls 19 and 20 positioned essentially parallel to one another at a distance equal to the shaft diameter. Shaft 5 is mounted in rotating fashion between side walls 19 and 20.

The force exerted by adjusting element 8 on control lever 4 acts along normal direction B of contact surface 9. The component of the force acting perpendicular to the connecting line of the contact point of control lever 4 on contact surface 9 to shaft axis 13, exerts a torque on shaft 5. The component of the force generated by the adjusting element in normal direction B, which acts in the direction of the connecting line, acts on shaft 5 as a transverse force. In this context, the transverse force in turn has a component acting in the normal direction towards side wall 20 and a component acting in tangential direction C of side wall 20. The component acting in tangential direction C of side wall 20 can cause shaft 5 to rise out of recess 18. Due to the fact that angle 23 between the direction of the side wall C and normal direction B is roughly 90° or less, the component of the force which causes shaft 5 to rise out of recess 18 is kept to a minimum. In addition, recess 18 can be retained by a cap (not shown in the Figures) mounted on pins 25.

In the version shown in FIG. 2, side walls 21 and 22 of recess 18 are again positioned parallel to one another at a distance equal to the shaft diameter. Tangential direction C of side wall 22, which absorbs the force of control lever 4, also forms a roughly right or acute angle 23 with normal direction B of contact surface 10. In contrast to the practical example in FIG. 1, contact surface 10 is positioned perpendicular to longitudinal direction A of adjusting mechanism 3. As a result, identical adjusting elements 8 can be inserted with the same orientation in the half-shells of housing 2.

In both configurations, adjusting element 8 is guided by two guide ribs 17 during the adjusting motion. Guide ribs 17 give housing 2 additional stability and contribute to absorbing the reactive forces in housing 2.

Via control lever 4, forces act on adjusting elements 3 which are transmitted via gear unit 6 to mounting element 15 of gear unit 6. In this context, mounting element 15 has ribs 16, which are in the shape of rings running around each half-shell of housing 2 and serve to fix a bearing for threaded spindle 7, for example. The reactive forces acting on the housing via mounting element 15 are absorbed by the tension forces in housing 2.

Switches 26 are arranged in a channel on the side of adjusting mechanisms 3 and can be actuated by adjusting element 8. Switches 26 can serve as limit switches for the respective motor 24.

What is claimed is:

1. A drive mechanism for adjusting parts in furniture for sitting and lying down, with a housing for accommodating two adjusting mechanisms driven by electromotors, each said electromotor for turning a shaft equipped with a control lever whereby two shafts are turnable, where the adjusting mechanisms each have an adjusting spindle which engages a gear unit at one head end, and an adjusting element which is threaded to the adjusting spindle, can be moved in the longitudinal direction and has a contact surface resting against the control lever, and said adjusting mechanisms are positioned in opposite directions, and where the adjusting mechanisms have a longitudinal side facing the shafts and a longitudinal side facing away from the shafts, characterized in that the longitudinal side of the one adjusting mechanism facing away from the shafts is positioned opposite the longitudinal side of the other adjusting mechanism facing the shafts.

2. The drive mechanism as in claim 1, characterized in that the adjusting mechanisms are essentially positioned opposite one another when the adjusting elements are in the position of a shortest vertical stroke.

3. The drive mechanism as in claim 1, characterized in that the adjusting mechanisms are arranged essentially parallel to one another in the housing.

4. The drive mechanism as in claim 1, characterized in that the longitudinal direction of the adjusting mechanisms is at an angle to a connecting plane containing the shaft axes.

5. The drive mechanism as in claim 1, characterized in that the housing consists of two half-shells with mounting elements for the gear units, each half-shell itself being integrally molded.

6. The drive mechanism as in claim 5, characterized in that the adjusting elements are guided in at least one half-shell by ribs arranged in the longitudinal direction.

7. The drive mechanism as in claim 1, characterized in that each of the shafts is mounted in a recess in the housing, where the recess has two side walls facing the shaft and the side wall, farthest away from the gear unit of the adjusting element acting on the shaft, forms a roughly right or acute angle with the normal direction of the contact surface at the contact point of the control lever.

8. The drive mechanism as in claim 1, characterized in that, with regard to the adjusting elements, a normal direction of the contact surface points in the longitudinal direction of the respective adjusting spindle and the side wall of the recess, farthest away from the gear unit of the adjusting element acting on the shaft, forms a roughly right or acute angle with the normal direction of the contact surface.

9. The drive mechanism as in claim 1, characterized in that the side walls of the recess are essentially perpendicular to a connecting plane containing the shaft axes and form a roughly right or acute angle with the normal direction of the contact surface of the adjusting element acting on the shaft.

10. The drive mechanism as in claim 1 characterized in that the motors are mounted on one side of the housing perpendicular to the longitudinal direction of the adjusting spindle.

* * * * *